US008895880B2

(12) United States Patent
Mizutani et al.

(10) Patent No.: US 8,895,880 B2
(45) Date of Patent: Nov. 25, 2014

(54) ELECTRIC POWER TOOL

(71) Applicants: Akira Mizutani, Anjo (JP); Tatsuya Yoneyama, Anjo (JP)

(72) Inventors: Akira Mizutani, Anjo (JP); Tatsuya Yoneyama, Anjo (JP)

(73) Assignee: Makita Corporation, Anjo-Shi (JP)

( * ) Notice: Subject to any disclaimer, the term of this patent is extended or adjusted under 35 U.S.C. 154(b) by 137 days.

(21) Appl. No.: 13/632,618

(22) Filed: Oct. 1, 2012

(65) Prior Publication Data

US 2013/0112537 A1 May 9, 2013

(30) Foreign Application Priority Data

Nov. 8, 2011 (JP) ..... 2011-244773

(51) Int. Cl.
*H01H 9/06* (2006.01)
*B25F 5/02* (2006.01)
*H01H 15/10* (2006.01)

(52) U.S. Cl.
CPC ..... *B25F 5/02* (2013.01); *H01H 15/102* (2013.01); *H01H 15/107* (2013.01)
USPC ..... 200/332.2

(58) Field of Classification Search
CPC ..... H01H 3/04; H01H 9/04; H01H 15/00; H01H 25/00; H01H 2021/00; H01H 2025/00; H01H 2223/01; H01H 2223/04; H01H 2231/052
USPC ..... 200/332.2, 60, 324, 441–443, 450, 453, 200/457–459, 531, 553, 571, 572, 293.1, 200/302.3, 318, 332, 339, 16 R, 329, 291, 200/321, 322, 252
See application file for complete search history.

(56) References Cited

U.S. PATENT DOCUMENTS 3,847,233 A * 11/1974 Glover et al. ..... 173/170
5,794,764 A 8/1998 Hirose et al.
2002/0100597 A1 8/2002 Numata

FOREIGN PATENT DOCUMENTS

JP A-2002-270066 9/2002

OTHER PUBLICATIONS

Extended European Search Report issued in European Application No. 12187233.7 dated Oct. 4, 2013.

* cited by examiner

*Primary Examiner* — Edwin A. Leon
*Assistant Examiner* — Anthony R. Jimenez
(74) *Attorney, Agent, or Firm* — Oliff PLC

(57) ABSTRACT

A reciprocating tool includes a toggle switch that is turned on or off by tilting a lever, and a switch lever in a motor housing. The switch lever includes an engagement frame into which the lever is inserted, and can slide in a tilting direction. The switch lever is slid to tilt the lever to an ON position or an OFF position through a sliding operation of the switch lever from the outside. An engagement portion of the switch lever on a side closer to the ON position of the lever is provided with a slanted guide surface that guides the lever in the ON position to the OFF position when the toggle switch is attached into an upper housing having the switch lever attached thereto.

11 Claims, 6 Drawing Sheets

ELECTRIC POWER TOOL

BACKGROUND OF THE INVENTION

This application claims the benefit of Japanese Patent Application Number 2011-244773 filed on Nov. 8, 2011, the entirety of which is incorporated by reference.

TECHNICAL FIELD

The present invention relates to an electric power tool in which a toggle switch (also called a "snap switch") accommodated in a housing is turned on or off through a sliding operation of a switch lever.

BACKGROUND ART

There are known electric power tools such as sanders that employ a toggle switch as a switch for opening and closing a driving circuit for a motor. The toggle switch is switched on or off by tilting a lever of the toggle switch through a sliding operation of a switch lever provided in a housing of the electric power tool (see, for example, Japanese Patent Application Publication No. 2002-270066 (JP 2002-270066 A)).

To attach this toggle switch to the housing, first, the switch lever is attached to the housing, and then the lever of the toggle switch is inserted between a pair of engagement portions provided in the switch lever.

However, when the switch lever is biased toward an OFF position by a coil spring or the like, the toggle switch cannot be attached, with the lever kept at an ON position because the lever interferes with the engagement portion on the ON position side of the switch lever. Therefore, the operator has to attach the toggle switch again after tilting the lever to an OFF position. The installation efficiency is thus reduced.

SUMMARY OF THE INVENTION

An object of the present invention is therefore to provide an electric power tool where adjusting the lever to the OFF position is not required during attachment of a toggle switch and that achieves high installation efficiency.

In order to achieve the object above, an electric power tool according to a first aspect of the present invention includes a toggle switch that is provided in a housing and turned on or off by tilting a lever, and a switch lever having a pair of engagement portions with which the lever is engaged on front and back sides in a tilting direction thereof. The switch lever is slidable in the tilting direction and tilts the lever to an OFF position or an ON position through a sliding operation from outside of the housing. The electric power tool further includes a slanted guide surface provided at the engagement portion of the switch lever on a side closer to the ON position of the lever. The slanted guide surface leads to tilt the lever in abutment therewith in the ON position toward the OFF position when the toggle switch is attached into the housing while the lever is inserted between the pair of engagement portions.

In the electric power tool according to a second aspect of the present invention, in a configuration according to the first aspect, a projection protruding toward the toggle switch is provided at the engagement portion of the switch lever on the side closer to the ON position of the lever, and the slanted guide surface is formed to extend from the engagement portion to the projection.

According to the first aspect of the present invention, when the toggle switch is attached, the lever can always be inserted between the engagement portions regardless of the position of the lever. Therefore, adjusting the lever to the OFF position becomes unnecessary, and high installation efficiency is achieved.

According to the second aspect of the present invention, in addition to the effect according to the first aspect, the slanted guide surface can be formed wide, thereby guiding the lever more reliably. The sliding operation of the switch lever using the projection is easily performed, thereby improving workability in relation to attachment of other components associated with the switch lever, such as an operation knob.

DETAILED DESCRIPTION OF THE EMBODIMENTS

In the following, an embodiment of the present invention will be described based on the drawings.

Figure 1:
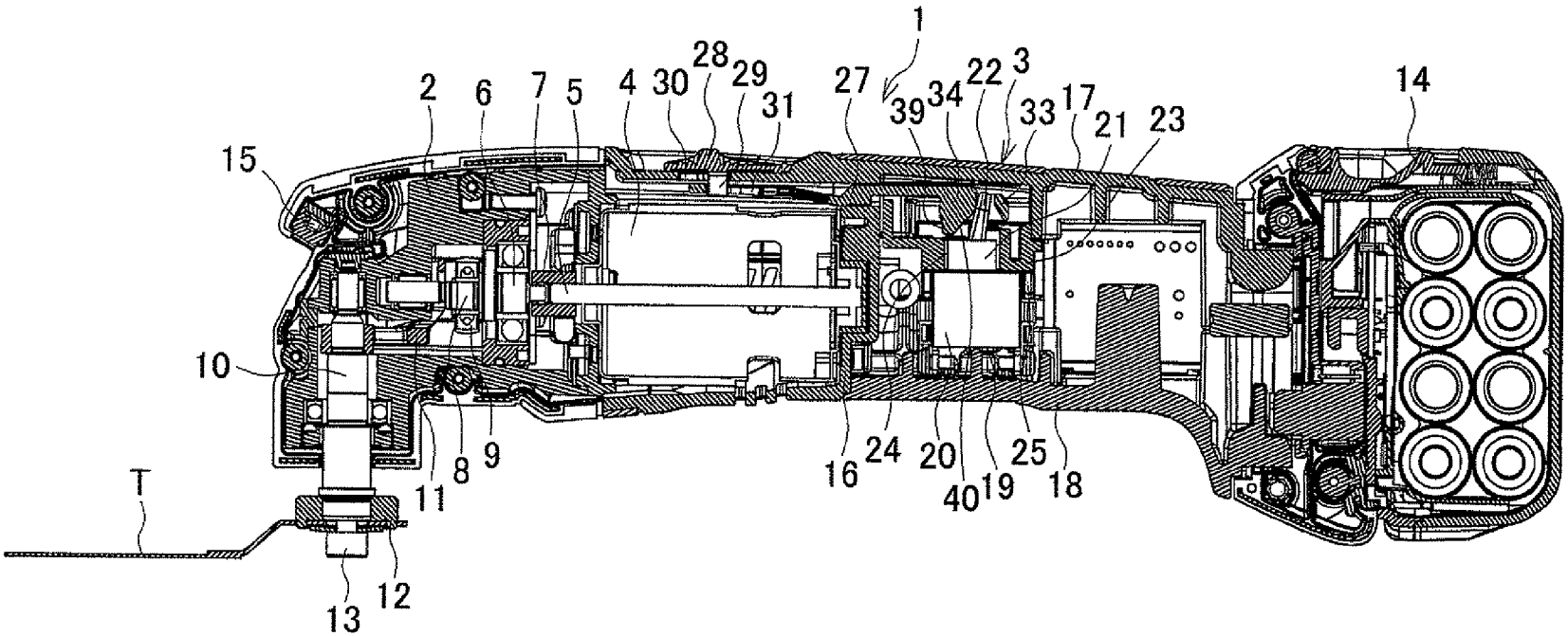
FIG. 1 is a longitudinal sectional view of a reciprocating tool.

FIG. 1 is a longitudinal sectional view of a reciprocating tool as an exemplary electric power tool. A reciprocating tool 1 includes a spindle 10 protruded downward from a front housing 2 on a front side (which is the left side in FIG. 1). The spindle 10 is reciprocally rotated from side to side at a prescribed angle. A motor 4 is accommodated in a tubular motor housing 3 that is connected to the back of the front housing 2. An output shaft 5 of the motor 4 is connected, through a coupling 7, to an intermediate shaft 6 that is pivotally supported in the front housing 2 so as to be concentric with the output shaft 5. An eccentric shaft portion 8 provided with a bearing 9 on the outer peripheral surface thereof is formed at an intermediate portion of the intermediate shaft 6. A swinging member 11 that has left and right rear ends extending to the left and right outer sides of the bearing 9 is connected to the spindle 10 that extends in a vertical direction and is pivotally supported in the front housing 2.

When the output shaft 5 rotates to cause the intermediate shaft 6 to rotate, the eccentric shaft portion 8 and the bearing 9 eccentrically move to swing the rear ends of the swinging member 11 from side to side. The spindle 10 is thus reciprocally rotated at a prescribed angle from side to side by means of the swinging member 11. A variety of tip tools T different in shape and use, such as cutting tools and polishing tools, can be detachably attached, with a bolt 13, to a flange 12 provided at a lower end of the spindle 10. A battery pack 14 serving as a power source is mounted at a rear end of the motor housing 3. An LED 15 is provided, facing downward, on the front side at an upper end of the front housing 2.

At the back of a retaining plate 16 that retains a rear portion of the motor 4, the motor housing 3 is halved into upper and lower parts, namely, an upper housing 17 and a lower housing 18. The upper housing 17 is integral with a front-side tubular portion for accommodating the motor 4. The lower housing 18 is attached to the upper housing 17 at the back of the retaining plate 16. A toggle switch 19 for opening and closing a driving circuit for the motor is provided between the upper and lower housings 17 and 18 at the back of the motor 4. The toggle switch 19 has a well-known structure in which a cylindrical bushing 21 for retaining a lever 22 is provided on the top of a quadrangular block-shaped case 20. A switch case 23 for retaining the toggle switch 19 is provided between the upper housing 17 and the lower housing 18.

Figure 2:
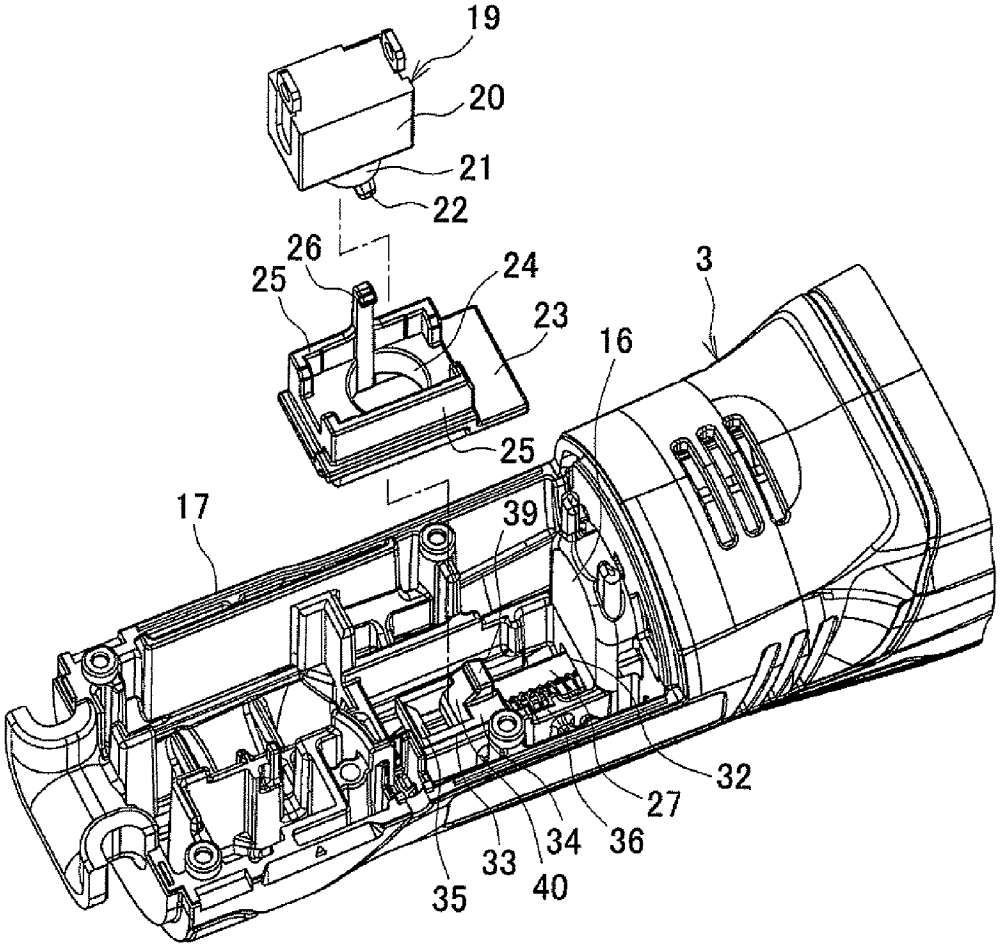
FIG. 2 is an exploded perspective view showing an attachment structure of a toggle switch from below.

As shown also in FIG. 2, the switch case 23 has a through hole 24 into which the bushing 21 can be inserted. In addition, the switch case 23 has a pair of left and right walls 25 and 25 and an engagement member 26. The case 20 of the toggle switch 19 can be fitted between the walls 25. The engagement member 26 is engaged with the lower surface of the case 20 when the case 20 is fitted between the walls 25 and 25. Specifically, the toggle switch 19 is retained in the switch case 23 and positioned between the upper and lower housings 17 and 18 by inserting the bushing 21 into the through hole 24 of the switch case 23, fitting the case 20 between the walls 25 and 25, and engaging the engagement member 26 with the case 20.

A switch lever 27 having a plate shape elongated in the front-back direction is accommodated, above the motor 4, in the upper housing 17 so as to be slidable in the front-back direction. The switch lever 27 is connected to an operation knob 28 that is provided to be slidable in the front-back direction on an upper outer surface of the upper housing 17. A connecting piece 29 provided on a lower surface of the operation knob 28 is passed through a through hole 30 of the upper housing 17 so as to protrude into the interior of the upper housing 17. Then, the connecting piece 29 is inserted in and engaged with a connecting hole 31 at a front end of the switch lever 27, whereby the switch lever 27 and the operation knob 28 are integrated in the front-back direction.

Figure 3:
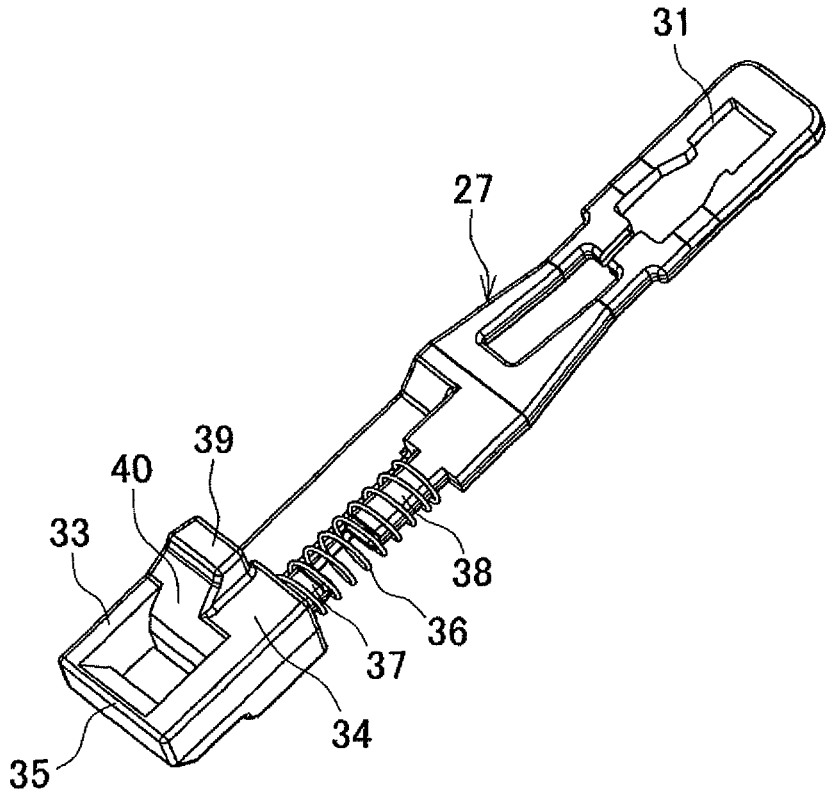
FIG. 3 is a perspective view of a switch lever.

The switch lever 27 protrudes toward the back of the motor 4 through a notch portion 32 formed in the retaining plate 16. At the rear end of the switch lever 27, as shown in FIG. 2 and FIG. 3, a quadrangular engagement frame 33 is formed, which has front and rear frame portions serving as engagement portions 34 and 35, respectively. The lever 22 of the toggle switch 19 is inserted in and engaged with the engagement frame 33.

The switch lever 27 is provided with a coil spring 36. A rear receiving portion 37 is projected on a front surface of the engagement frame 33 and a front receiving portion 38 is projected in front of the rear receiving portion 37 to face the rear receiving portion 37. The rear receiving portion 37 and the front receiving portion 38 are inserted through both ends of the coil spring 36, whereby the coil spring 36 is attached so as to generally fit in the width size of the switch lever 27. In the state in which the switch lever 27 is attached to the upper housing 17, the front end of the coil spring 36 abuts on the retaining plate 16 and is compressed. Therefore, the switch lever 27 and the operation knob 28 are biased in a backward position in FIG. I in a normal state. The engagement frame 33 in this backward position corresponds to an OFF position of the lever 22 of the toggle switch 19.

Here, at the engagement portion 34 on the front side of the engagement frame 33, a projection 39 protruding downward is provided. A slanted guide surface 40 is formed, extending from the rear surface of the projection 39 to the inner surface of the engagement portion 34, so as to gradually recede from the insertion side of the lever 22 (the lower side in FIG. 1) to the protruding side of the lever 22 (the upper side in FIG. 1). The slanted guide surface 40 is provided at a position where the tip end of the lever 22 in an ON position abuts thereon when toggle switch 19 is attached to the upper housing 17 in the backward position of the switch lever 27.

In the reciprocating tool 1 configured as described above, for attachment of the switch lever 27 and the operation knob 28 to the upper housing 17, first, the switch lever 27 with the coil spring 36 is attached into the upper housing 17, and thereafter, the operation knob 28 is attached from the outside of the upper housing 17. Here, it is necessary to move the switch lever 27 forward against biasing of the coil spring 36. Using the projection 39 provided at the engagement frame 33, the switch lever 27 can be easily slid to the forward position with the fingers.

Figure 4:
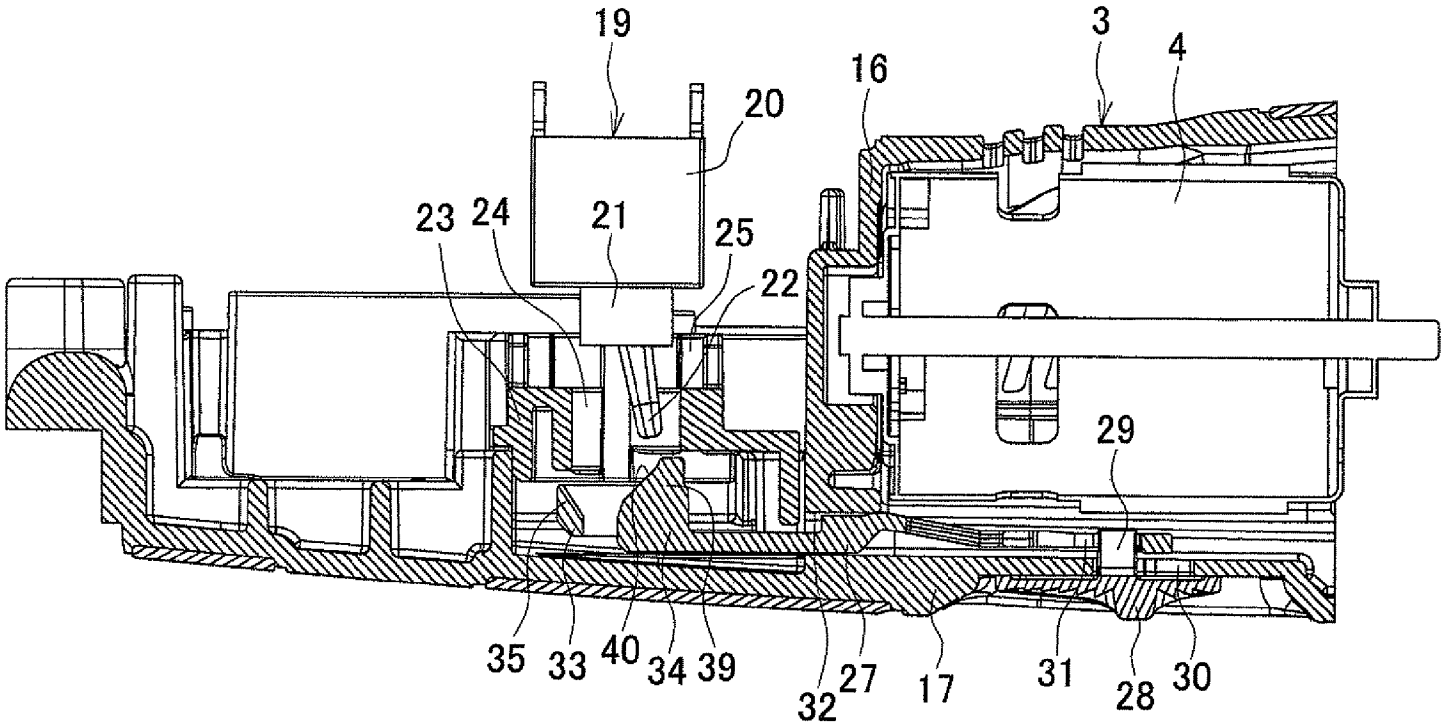
FIG. 4 is an illustrative view showing an attachment state of the toggle switch.
Figure 5:
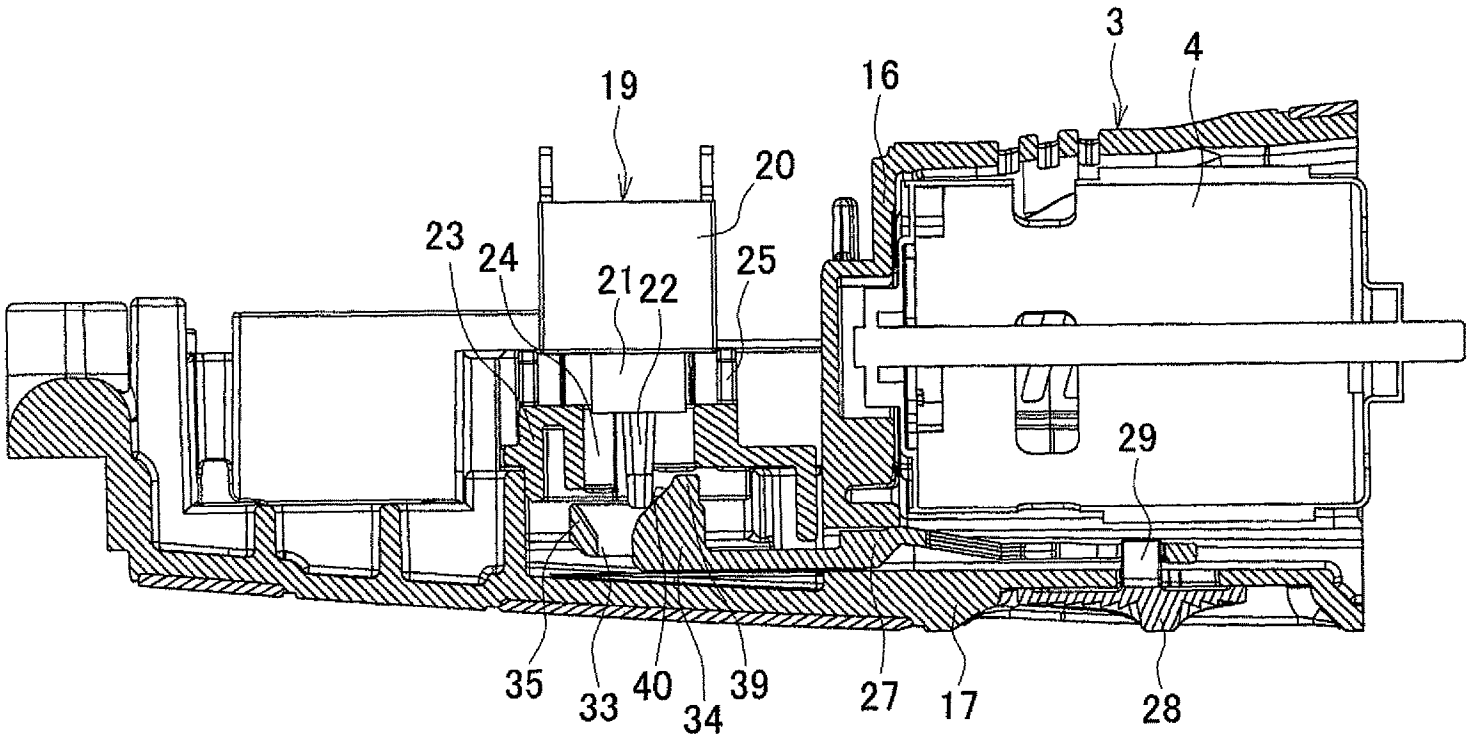
FIG. 5 is an illustrative view showing an attachment state of the toggle switch.
Figure 6:
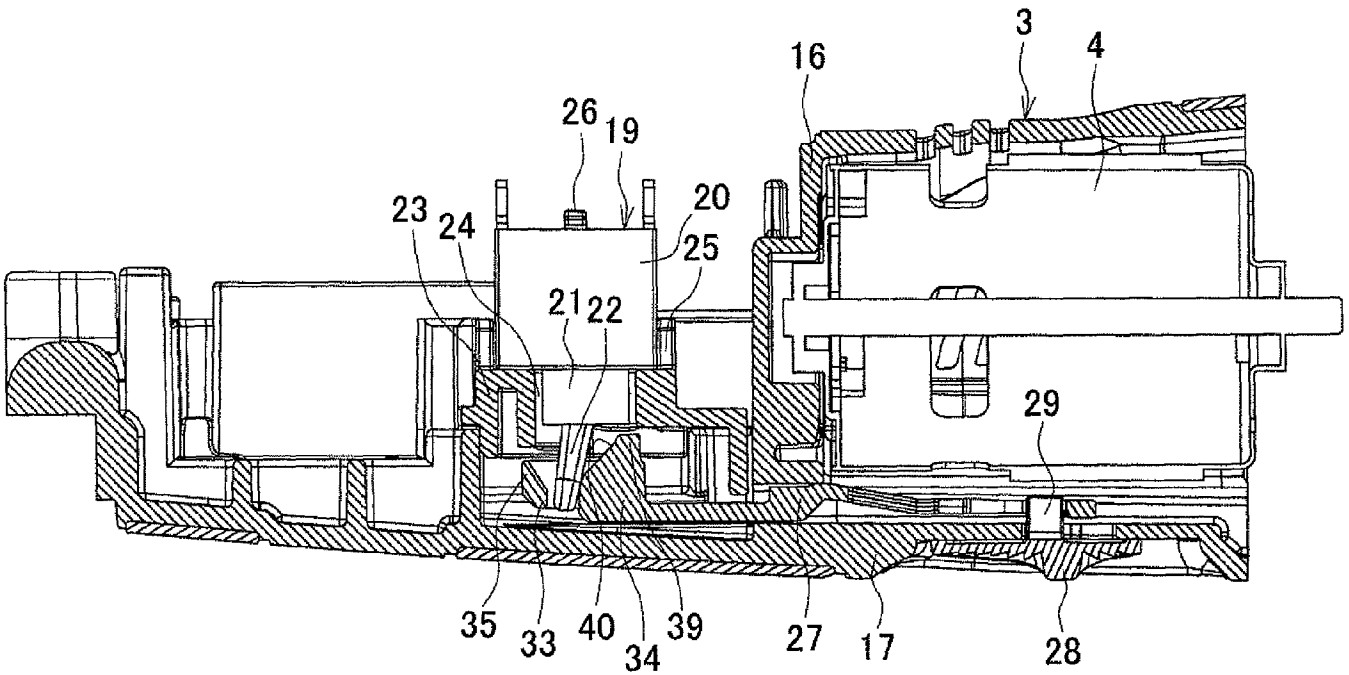
FIG. 6 is an illustrative view showing an attachment state of the toggle switch.

Then, for attachment of the toggle switch 19, the switch case 23 is attached while the upper housing 17 having the switch lever 27 previously attached thereto is placed as shown in FIG. 4. Thereafter, the toggle switch 19 is pushed downward with the lever 22 facing downward such that the bushing 21 is inserted into the through hole 24 of the switch case 23. Here, even if the toggle switch 19 is attached with the lever 22 kept at the ON position, the lever 22 comes into abutment with the slanted guide surface 40 provided at the engagement frame 33, as shown in FIG. 5. Then, the lever 22 is guided to the OFF position (the left side in FIG. 5) by the slanted guide surface 40 as the toggle switch 19 is pushed. Then, the case 20 is fitted between the walls 25, and the engagement member 26 is engaged with the case 20. Thus, as shown in FIG. 6, the lever 22 is inserted in and engaged with the engagement frame 33 in the OFF position.

During work with the reciprocating tool 1, when the operation knob 28 is slid forward against biasing of the coil spring 36, the switch lever 27 also slides forward, so that the engagement portion 35 on the rear side of the engagement frame 33 leads to tilt the lever 22 to the front-side ON position. As a result, the toggle switch 19 is turned on to drive the motor 4, causing the spindle 10 to reciprocally rotate as described above. When the operation knob 28 is slid backward, the switch lever 27 moves backward together with the operation knob 28, so that the engagement portion 34 on the front side of the engagement frame 33 leads to tilt the lever 22 to the back-side OFF position. As a result, the motor 4 is stopped, and the reciprocating rotation of the spindle 10 is stopped.

As described above, in the reciprocating tool 1 in the foregoing embodiment, the engagement portion 34 of the switch lever 27 on a side closer to the ON position of the lever 22 is provided with the slanted guide surface 40. The slanted guide surface 40 leads to tilt the lever 22 in abutment therewith in the ON position toward the OFF position when the toggle switch 19 is attached into the upper housing 17 while the lever 22 is inserted between the pair of engagement portions 34 and 35. Accordingly, during attachment of the toggle switch 19, the lever 22 can always be inserted between the engagement portions 34 and 35 regardless of the position of the lever 22. Therefore, adjusting the lever 22 to OFF position becomes unnecessary, and high installation efficiency can be achieved.

In particular, here, the projection 39 protruding toward the toggle switch 19 is provided at the engagement portion 34 on the ON position side, and the slanted guide surface 40 is formed to extend from the engagement portion 34 to the projection 39, so that the slanted guide surface 40 can be formed wide, thereby guiding the lever 22 more reliably. The sliding operation of the switch lever 27 using the projection 39 can be easily performed, thereby improving workability in relation to the attachment of other components associated with the switch lever 27, such as the operation knob 28.

The slanted guide surface is not limited to a flat surface and may be a curved surface or a bulging surface as long as it can guide the lever. The projection of the engagement frame may be eliminated, and the slanted guide surface may be provided only at the inner surface of the engagement portion.

In the forgoing embodiment, the backward position of the switch lever is the OFF position and the forward position is the ON position. However, the opposite is also possible. In that case, the engagement portion provided with the slanted guide surface is reversed in the front-back direction.

In addition, the engagement portion of the switch lever is not limited to the one that is provided in the quadrangular engagement frame as in the foregoing embodiment. It is also possible to employ an engagement frame having an angled C-shape in a plan view with engagement portions on the front and back sides, or an engagement frame having an inverted angled U-shape in a side view with engagement portions protruding downward.

The present invention can be integrated with the structure of the switch case and the housing. The applicable electric power tool is not limited to a reciprocating tool. The present invention is applicable to other electric power tools such as a sander or a grinder as long as the tool is turned on or off with the switch lever that slides the toggle switch.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An electric power tool comprising:

a toggle switch that is provided in a housing and turned on or off by tilting a lever;

a switch lever having a pair of engagement portions with which the lever is engaged on front and back sides in a tilting direction thereof, the switch lever being slidable in the tilting direction and tilting the lever to an ON position or an OFF position through a sliding operation from outside of the housing; and a slanted guide surface provided at the engagement portion of the switch lever on a side closer to the ON position of the lever, the slanted guide surface being different from a portion of the engagement portion which engages the lever when the switch lever slides in the tilting direction, the slanted guide surface being structured such that the slanted guide surface tilts the lever in abutment therewith in the ON position toward the OFF position when the toggle switch is attached into the housing while the lever is inserted between the pair of engagement portions.

2. The electric power tool according to claim 1, wherein a projection protruding toward the toggle switch is provided at the engagement portion of the switch lever on the side closer to the ON position of the lever, and the slanted guide surface is formed to extend from the engagement portion to the projection.

3. The electric power tool according to claim 1, wherein a quadrangular engagement frame into which the lever of the toggle switch is inserted is provided at an end portion of the switch lever, and the engagement portions are provided at front and rear frame portions of the engagement frame.

4. The electric power tool according to claim 1, wherein the switch lever is biased toward a side closer to the OFF position of the lever by means of a coil spring.

5. The electric power tool according to claim 4, wherein the coil spring is attached along the switch lever so as to fit in a width size of the switch lever and includes an end portion that comes into abutment with the housing, thereby biasing the switch lever toward the side closer to the OFF position of the lever.

6. The electric power tool according to claim 1, wherein the housing is halved into an upper housing and a lower housing, and the toggle switch is provided between the upper and lower housings.

7. The electric power tool according to claim 6, wherein a switch case for retaining the toggle switch is provided between the upper housing and the lower housing.

8. The electric power tool according to claim 7, wherein the switch case includes a pair of walls between which a case of the toggle switch is capable of being fitted.

9. The electric power tool according to claim 8, wherein the switch case includes an engagement member that is engaged with the case when the case is fitted between the walls.

10. The electric power tool according to claim 6, wherein the switch lever is connected to an operation knob provided so as to be slidable in a front-back direction on an upper outer surface of the upper housing.

11. An electric power tool comprising:

a toggle switch that is provided in a housing and turned on or off by tilting a lever;

a switch lever having a pair of engagement portions with which the lever is engaged on front and back sides in a tilting direction thereof, the switch lever being slidable in the tilting direction and tilting the lever to an ON position or an OFF position through a sliding operation from outside of the housing; and a slanted guide surface provided at the engagement portion of the switch lever on a side closer to the ON position of the lever, the slanted guide surface being structured such that the slanted guide surface tilts the lever in abutment therewith in the ON position toward the OFF position when the toggle switch is attached into the housing while the lever is inserted between the pair of engagement portions, wherein a quadrangular engagement frame into which the lever of the toggle switch is inserted is provided at an end portion of the switch lever, and the engagement portions are provided at front and rear frame portions of the engagement frame.

* * * * *